US006173907B1

(12) United States Patent
Benoist

(10) Patent No.: US 6,173,907 B1
(45) Date of Patent: Jan. 16, 2001

(54) DISPENSER FOR DISPENSING IN THE FORM OF FINE DROPLETS A LIQUID PRODUCT WITH A FILM-FORMING POLYMER

(75) Inventor: Jean-Francois Benoist, Paris (FR)

(73) Assignee: L'Oreal, Paris (FR)

( * ) Notice: Under 35 U.S.C. 154(b), the term of this patent shall be extended for 0 days.

(21) Appl. No.: 09/000,494

(22) PCT Filed: Jun. 5, 1997

(86) PCT No.: PCT/FR97/00997

§ 371 Date: Sep. 18, 1998

§ 102(e) Date: Sep. 18, 1998

(87) PCT Pub. No.: WO97/47535

PCT Pub. Date: Dec. 18, 1997

(30) Foreign Application Priority Data

Jun. 10, 1996 (FR) ..... 96 07158

(51) Int. Cl.[7] ..... B65D 83/14
(52) U.S. Cl. ..... 239/337; 222/402.1; 239/372
(58) Field of Search ..... 239/337, 239, 239/372, 344, 369; 222/402.1, 402.18

(56) References Cited

U.S. PATENT DOCUMENTS 3,033,473 * 5/1962 Kitabayshi ..... 239/372 X
3,137,418 * 6/1964 Shepherd et al. ..... 239/372 X
4,417,674 * 11/1983 Giuffredl ..... 222/402.18
5,125,546 * 6/1992 Dunne et al. ..... 222/402.18 X

FOREIGN PATENT DOCUMENTS

2209805 * 5/1989 (GB) ..... 222/402.18

* cited by examiner

*Primary Examiner*—Andres Kashnikow
*Assistant Examiner*—Sean O'Hanlon
(74) *Attorney, Agent, or Firm*—Oblon, Spivak, McClelland, Maier & Neustadt, P.C.

(57) ABSTRACT

A dispenser (1) for a liquid product (P) containing a film-forming polymer in the form of fine droplets, includes a container (2) containing the product (P) and at least one propellant gas (G). A valve (15) for dispensing the product, mounted on the container (2), includes a body (24) provided with a first chamber (28*a*) and a second chamber (28*b*), intercommunicating via a passage (p), movable element (16) for actuating the valve (15) being provided for the dispensing of the product, the first chamber (28*a*) being provided with a first additional gas intake opening ($d_1$), and a second opening ($d_2$) for the intake of the product in permanent communication with this product, the second chamber (28*b*) at least partially formed of the actuating element (16). In this valve, the delivery rate during the dispensing of the product (P) is determined by the cross-section of the passage (p).

25 Claims, 3 Drawing Sheets

DISPENSER FOR DISPENSING IN THE FORM OF FINE DROPLETS A LIQUID PRODUCT WITH A FILM-FORMING POLYMER

BACKGROUND OF THE INVENTION

1. Field of the Invention

The present invention relates to a dispenser of a liquid product containing a film-forming polymer. More particularly, this dispenser is an aerosol dispenser comprising a container with a pressurized propellant gas, a dispensing nozzle, and a dispensing valve for actuating the dispensing of the product at will and for allowing this product to be delivered in the form of fine droplets or a mist.

In accordance with the invention, the product to be sprayed is an aqueous or hydroalcoholic composition containing at least one film-forming polymer. More particularly, this composition is a hair composition such as a lacquer for holding the hair, a brushing out lotion, a setting lotion, or a hair-styling solution.

2. Description of the Background

Conventionally, the hair compositions to be sprayed onto the hair are in essence constituted by an alcoholic or hydroalcoholic solution and a solubilized polymer, optionally in a mixture with various cosmetic adjuvants. Usually this solution is packaged either in a pump bottle or in an appropriate pressurized container.

For some years, particular interest has been shown in obtaining essentially aqueous cosmetic hair compositions. Indeed, the use of an alcohol such as ethanol or isopropanol on its own or in a mixture with a small proportion of water may have certain drawbacks, in particular inflammability.

Moreover, for economic and ecological reasons, attempts are increasingly being made to reduce the content of volatile organic compounds present in cosmetic compositions, mainly solvents such as ethanol, that are sprayed into the atmosphere.

To reduce the quantity of volatile compounds, an attempt has been made to replace by water the solvents such as ethanol. However, although most of the hydrosoluble film-forming polymers in an aqueous solution may lead to obtaining a composition for fixing the hair, they have major drawbacks. Thus the essentially aqueous solutions of these hydrosoluble polymers do not allow high degrees of fixation to be obtained. It has been proposed to use these hydrosoluble polymers in high concentrations, but an increase in their concentration produces such an increase in the viscosity of the compositions that satisfactory spraying can be obtained only with great difficulty. Even if correct spraying is obtained, these aqueous compositions have a particularly long drying-out time as compared with alcohol-based compositions, which gives them but little practical value.

It has also been proposed to use aqueous dispersions of insoluble particles of polymers, instead of solubilized polymers. However, to date, the results obtained have not yet been satisfactory. In particular, the Applicant has found that when one tries to use, in a conventional aerosol dispenser, high concentrations of polymers that are insoluble in the medium, in particular an aqueous medium, the quality of the spray is not satisfactory. The atomized liquid particles are not fine; frequently the spray is not diffuse and the dispensing is irregular. To avoid an excessive drying-out time of an aqueous dispersion, the Applicant has tried to reduce the delivery rate of the valve during the dispensing of the product. In these conditions, it has been found that the spraying nozzle and/or the dispensing valve frequently have a tendency to clog up. Moreover, the Applicant has noted the formation of foam round the spray opening which is prejudicial to the spraying quality. Moreover, this foam flows onto the container and dirties the user's fingers.

From EP-A-0 008 109, there is known a pressurized dispenser for the dispensing of a liquid product or of a dispersion of particles. This dispenser is provided with a valve comprising a main body and a prenuxing chamber provided with an additional gas intake. The product is passed into this chamber via a capillary dip tube. The chamber communicates with the valve body. The valve body can be caused to communicate with a spraying nozzle by operating an actuating stem that has for this purpose a passage opening obturated in the rest position. The delivery rate of the valve is determined by the cross-section of the capillary tube. According to this document, the inflammability of the product to be sprayed is reduced by using a valve with a premixing chamber.

Moreover, U.S. Pat. No. 3,653,553 discloses a dispenser with a sequential valve comprising an additional gas intake and provided with a premixing chamber. This valve is configured in such a way as to allow the dispensing ducts down the line from the valve to be purged by a jet of pure propellant gas. The valve is provided with an antechamber into which there leads an additional gas intake. A kneed duct obtained in the bottom portion of the actuating stem connects this antechamber to the internal space of the valve body. During a partial depression of the actuating stem, propellant gas penetrates into the antechamber, resulting in a drop in the internal pressure in the antechamber, so that any drawing-in of the product via a drawing-in duct is prevented. During the complete depression of the valve stem the duct is obturated by a projection of the stem so that a gas/product mixture can be dispensed. During this complete depression, the internal space of the antechamber is occupied substantially completely by the lower portion of the stem, so that in the dispensing position, this antechamber is substantially non-existent. In other words, in the dispensing position, this valve has almost no antechamber. With such a device, the problem of the presence of foam in the upper portion of the device (in particular round the spray opening) occurs to a substantial extent.

Furthermore, BE-A-664 905 describes a valve of the same kind. At the bottom of the valve body, there is provided an opening for the intake of the product, leading into a premixing chamber provided with an additional gas intake. The premixing chamber is separated from the main valve chamber by an elastomeric partition which is traversed by a passage opening. During the actuation of this valve, the elastomeric partition is pushed towards the bottom of the valve body, so that the premixing chamber becomes virtually non-existent. The problems posed by such a device are identical with those described with reference to U.S. Pat. No. 3,653,553.

Since the correct atomization is an essential element for the final quality of the application of a hair composition to be sprayed onto the hair, it is of the utmost importance to remedy these drawbacks to obtain a good quality spray with fine particles and a good spread of the spray over the head of hair as a whole.

SUMMARY OF THE INVENTION

The Applicant has now discovered that by reducing the dispensing rate, as compared with a delivery rate generally used, and by associating a cosmetic composition containing at least one insoluble polymer in an appropriate aqueous medium with a dispenser fitted with a particular valve, it was possible to reduce and even to suppress the clogging of the spraying nozzle. This valve is of the kind that comprises a premixing chamber for the product/gas into which there leads an additional gas intake, a passage with a given cross-section connecting the inside of the valve body to the premixing chamber, so that the delivery rate of the valve is determined by the cross-section of the passage. The Applicant has, moreover, surprisingly found that by using this particular valve, the formation of foam round the spraying nozzle was suppressed, or in any case localized at points that do not to any appreciable extent affect the proper functioning of the device.

The present invention therefore provides a dispenser of a liquid product containing at least one film-forming polymer in the form of fine droplets, comprising a container containing the liquid and at least one propellant gas; a valve for dispensing the liquid mounted on the container, the valve comprising a body provided with a first and a second chamber intercommunicating via a passage; and movable means for actuating the valve for the dispensing of the product; wherein the first chamber is provided with a first additional gas intake opening, and a second opening for the intake of the liquid in permanent communication with this liquid; wherein the second chamber comprises at least partially the actuating means; and wherein the liquid contains water at at least 15% of the total weight of the product. The Applicant has found that by choosing the dimensions of the first and second openings in such a way that the ratio of the diameter of the first opening/diameter of the second opening is approximately 0.3 to approximately 1, and by arranging the valve so that its delivery rate is determined by the cross-section of the passage, a better quality of spraying (size of the droplets) could be obtained.

Thus the invention makes it possible to obtain a good atomization; the spray is regular and the sprayed drops are fine. The product is distributed easily over the whole head of hair. Finally, the drying-out time of this spray on the head of hair is short.

DETAILED DESCRIPTION OF THE INVENTION

The product, as well as the propellant gas, are packaged in a conventional aerosol container for them. According to an important aspect of the invention, this reservoir is surmounted by a double-chamber valve, fixed on the reservoir for example by means of a metallic cup. Advantageously, this container is fitted with means for actuating the valve, for example by a hollow actuating stem connecting the valve to a dispensing head or push button provided with a dispensing opening, for example, a spraying nozzle. This nozzle may be a conventional swirling or semi-swirling nozzle, such as that described in DE-A-1 209 517 for example, that is to say a nozzle capable of imparting a swirling motion to the product and gas mixture before it leaves the nozzle. Preferably, the valve that can be used in accordance with the invention is a valve with an actuating stem, termed a male valve emerging from the valve body capable of being urged against an elastic restoring element, such as a spring accommodated in the valve body. It is also possible to use a female valve which is associated with a dispensing head fitted with a stem, or yet again a lateral-deformation valve. This valve advantageously comprises an additional gas intake.

Advantageously, the valve stem has a dispensing duct, obturated in the rest position of the valve, and open during the dispensing of the product.

As an example of a valve having first and second chambers usable in the invention, we may mention a valve of the kind described in U.S. Pat. No. 3,159,318 or EP-A-0 445 358, subject to the cross-section of the various passages having been adjusted as described above.

According to a preferred embodiment, the diameter of the dispensing duct of the actuating means is greater than the diameter of the passage between the chambers and has, for example, a diameter of approximately 0.4 mm to approximately 1.0 mm.

Advantageously, the first and second valve chambers are aligned along the same axis. According to a first embodiment, they are separated by a fixed transverse partition onto which the passage is cut. According to a second, preferred embodiment, the partition is movable and joined to the actuating means. In this case, the passage forms a kneed duct connecting the first and second chambers, the partition taking the form of a piston sliding in the valve body in a leakproof manner.

According to another advantageous aspect of the invention, this passage has a diameter chosen so that the delivery rate of the product during its dispensing is approximately 200 mg/s to approximately 600 mg/s. In practice, this passage may have a diameter of approximately 0.2 mm to approximately 0.5 mm, chosen according to the desired delivery rate of the product and the viscosity of the product. Thus after passing along the passage, the product does not encounter any restriction with a diameter smaller than the diameter of the passage, so that the delivery rate of the valve is determined by the cross-section of the passage.

Advantageously, the additional gas intake opening, called the first opening, has a diameter at most equal to the diameter of the intake opening for the product, called the second opening.

The second opening forms an internal restriction cut in a conduit for the admission of the product, allowing the product to be passed from the container towards the first chamber of the valve. This conduit is, for example, a dip tube whose free end is permanently immersed in the product.

Thus the first opening may have a diameter of approximately 0.2 mm to approximately 0.6 mm and the second opening also a diameter of approximately 0.2 mm to approximately 0.6 mm. Advantageously, the first diameter has a diameter at most equal to the diameter of the second opening.

Advantageously, the product contained in the dispenser is a hair product, such as a lacquer for fixing the hair, a brushing-out lotion, a setting lotion, or a hair styling lotion.

Generally, the product comprises an essentially aqueous or slightly hydroalcoliolic medium.

The continuous aqueous or hydroalcoholic medium serving as a support for the product used in accordance with the invention is preferably constituted by water or a mixture of water with cosmetically acceptable solvents, such as monohydric alcohols, polyhydric alcohols and glycol ethers, which may be used in low concentrations on their own or in a mixture. Still more preferentially, the support is in essence constituted by water.

The polymer may be present in this medium in a solubilized form. However, according to a particular advantageous aspect of the invention, the polymer is dispersed in the product. If required, it is possible to associate one or several soluble polymers with one or several polymers dispersed in the medium.

When the polymer is a dispersed polymer, its particulate size is preferably less than 1 $\mu$m.

Generally, this or these polymers may be of a cationic, anionic, amphoteric or non-ionic kind.

The aqueous dispersions of insoluble polymer particles which can be used in accordance with the invention are generally obtained by polymerization or copolymerization in a suspension or an emulsion of monomers, according to procedures well known in the state of the art. Such dispersions are also known under the name of "latex". Preferably, when this polymer takes the form of a "latex", it is the result of the polymerisation or copolymerization of monomers chosen from styrene, butadiene, ethylene, propylene, toluene vinyl, propionate vinyl, vinyl alcohol, acrylonitrile, chloroprene, vinyl acetate, urethanes, isoprene, isobutene, and the esters or amides of acrylic or methacrylic acids, maleic, crotonic or itaconic acids, vinyl ether, vinyl pyrrolidone, vinyl imidazole, their esters and their amides.

Such dispersed polymers are described, for example, in EP-A-0 590 604.

An aqueous polymeric dispersion which can be used in accordance with the invention, comprises, for example, 25% by weight of a copolymer of ethyl acrylate/methyl methacrylate/methacrylic acid/acrylic acid having a vitreous transition temperature of approximately 30° C., sold in particular by the AMERCHOL Company under the commercial name of AMERHOLD DR-25.

Aqueous dispersions also suitable for the invention are also the aqueous dispersions of copolymers of butyl styrene/acrylate, such as for example, the product sold by the D.S.M. Resins Company under the commercial name of URAMUL SC 70.

According to an advantageous aspect of the invention, the (soluble and/or dispersed) polymers are present in a proportion at least equal to 15% of the total weight of the product. In particular, the proportion of the polymer is chosen from 15% to 50% of the total weight of the product, and preferably from 15% to 35% of the total weight of the product (excluding the propellant).

According to a particularly preferred embodiment of the invention, a copolymer is used which comprises 50 to 60% by weight of ethyl acrylate, 30 to 40% by weight of methyl methacrylate, and 2 to 10% by weight of methacrylic acid, the total concentration of the acrylic and methacrylic acid not exceeding 15% by weight with respect to the to the total weight of the acrylic copolymer.

The pH of the products aimed at by the invention is generally from 2 to 9, and in particular from 3 to 8. It can be adjusted to the desired value by means of alkalinizing or acid-forming agents generally used in cosmetics for this type of application.

The products in accordance with the invention may also contain preservatives, sequestering agents, perfumes, silicones, colourants, viscosity-modifying agents, antifoaming agents, antipellicular agents, antiseborrheic agents, sun filters, proteins, vitamins, plasticizers, perfumes or conditioning agents. These conditioning agents may be chosen from oils and natural or synthetic waxes, fatty alcohols, esters of polyhydric alcohols, glycerides, polymers, and mixtures of these various compounds.

The product in accordance with the invention is pressurized in the form of an aerosol in an appropriate dispenser comprising the product as described above and at least one propellant gas which may be chosen from volatile hydrocarbons such as n-butane, propane, isobutane, pentane, chlorinated hydrocarbons and/or fluorocarbons, dimethylether, and their mixtures.

In such a system, the concentration of the propellant gas (or gases) is generally from 10 to 50% by weight with respect to the total weight of the pressurized product, and preferably from 15 to 35% by weight.

As propellant gas, there may also be used, carbon dioxide, hydrogen monoxide, hydrogen, compressed air and their mixtures.

According to a preferred embodiment of the invention, the concentration of the polymer is preferably at least 7% by weight with respect to the weight of the pressurized product (product+propellant), and even more preferentially it is from 10% to 35% by weight.

The Applicant has surprisingly found that, in contrast to the use of a single-chamber valve with an additional gas intake, by using a dispenser and a product such as described above, and by adhering to the dimensions of the valve openings indicated above, there did not occur any formation of foam at the outlet of the dispensing nozzle. Moreover, no clogging was observed in the course of the dispensing. Furthermore, the quality of the spray is good and homogeneous (in terms of the granulometric size, and spread of the droplets on the surface reached) from the beginning to the end of the dispensing.

BRIEF DESCRIPTION OF THE DRAWINGS

To render the present invention more readily understood, two embodiments in accordance with the invention will now be described by way of purely illustrative and in no way restrictive examples, with reference to the attached drawings.

DESCRIPTION OF THE PREFERRED EMBODIMENTS

Figure 1:
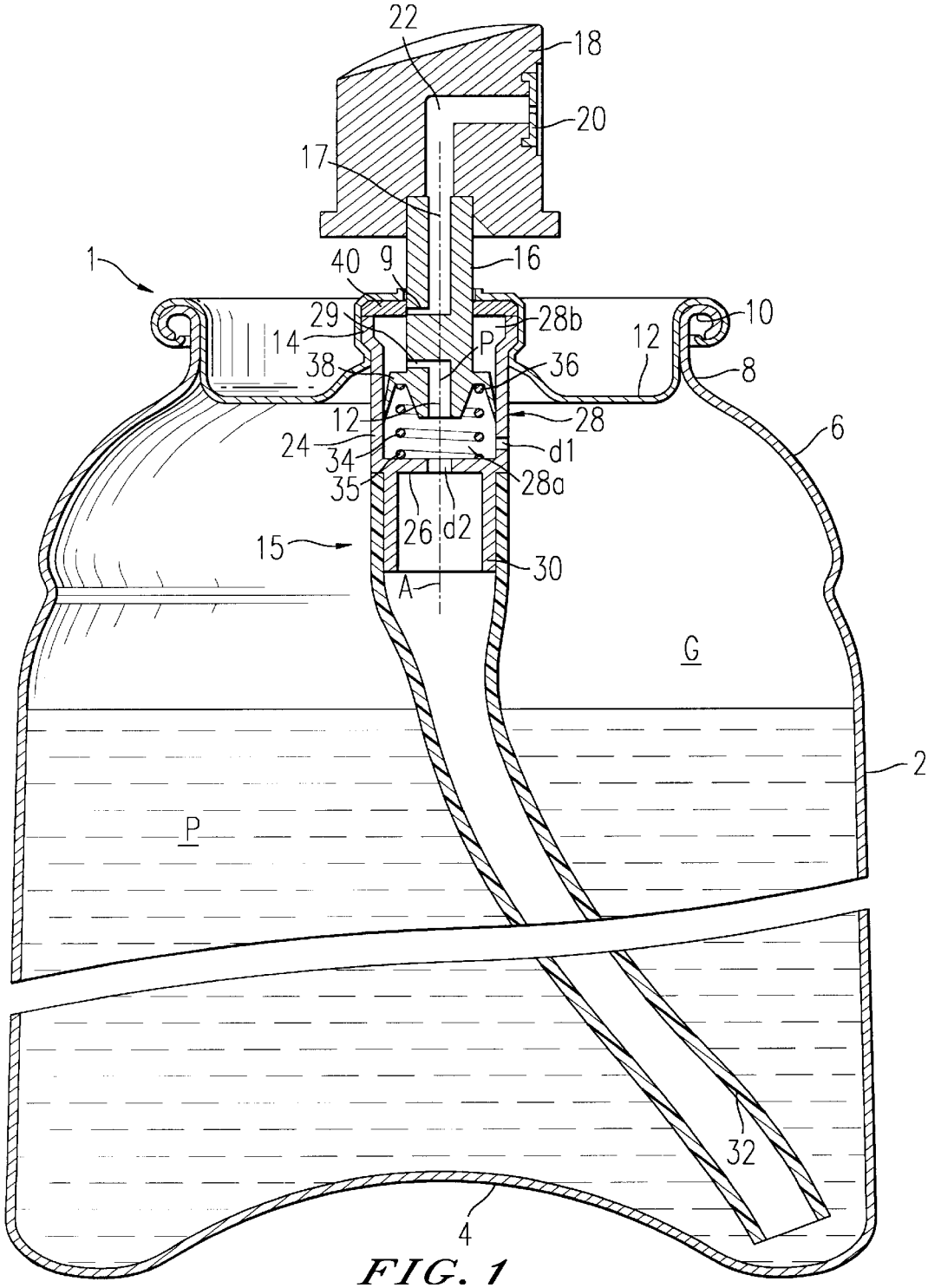
FIG. 1 shows an axial section of a dispenser according to a first embodiment of the invention in the storage position.
Figure 2:
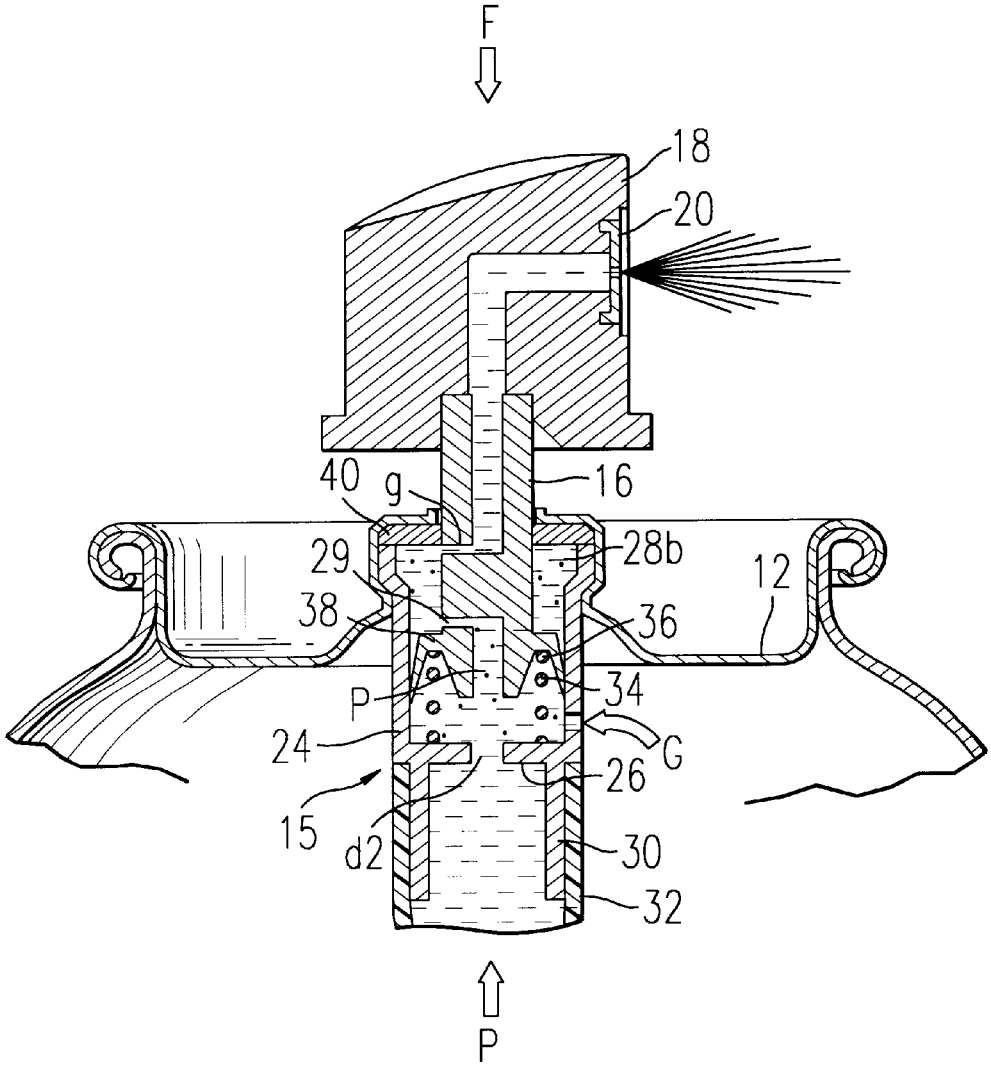
FIG. 2 shows a partial axial section of the dispenser of FIG. 1 in the position of use.

Referring to FIGS. 1 and 2 there will be seen a dispenser, designated as a whole by the reference numeral 1, for a hair lacquer P with a dispersed film-forming polymer, which is pressurized by means of a propellant gas G in order to ensure the spraying of the lacquer P in the form of fine droplets. This dispenser comprises a generally cylindrical container 2 with a closed bottom 4 forming a reservoir for the lacquer P. In FIG. 1, the lacquer P will be seen in the lower portion of the container, surmounted by a gaseous phase constituted by the propellant gas comprising which is then situated in the upper portion of the container. The end remote from the bottom 4 of the container 2 is shaped in the form of a dome 6 having a cylindrical neck 8 with a diameter smaller than that of the container 2, and ending in a rolled annular edge 10. A valve carrier cup 12, fixed in the neck 8, for example by crimping, has a body 14 of the valve 15 mounted therein in the conventional way. This valve 15 is a push-down type valve comprising a hollow actuating stem 16 emerging towards the outside of the container 2. A push button 18 provided with a spraying nozzle 20 is fixed on the stem 16. This nozzle 20 is, for example, a known swirling or semi-swirling nozzle 20. Inside the push button 18, the kneed dispensing duct 22 connects the nozzle 20 to the stem 16.

The body 14 of the valve 15 has a central axis A, a substantially cylindrical side wall 24, a circular bottom 26 and, on the opposite side to the bottom 26, a sealing washer 40 made of an elastomeric material, these elements defining a chamber 28. The washer 40 is traversed in a leakproof manner by the stem 16.

The chamber 28 is made up of two parts 28*a* and 28*b*; the chamber 28*a* is situated on the side of the bottom 26 and forms a chamber for premixing the propellant gas G/lacquer P. For this purpose, a first additional gas intake opening $d_1$ is provided in the side wall 24 of the valve body in the vicinity of the bottom 26, allowing the propellant gas G present in the upper portion of the container 2 to gain access to the chamber 28*a*. Moreover, in the bottom 26 there is cut a second central opening $d_2$ intended to communicate with the lacquer contained in the container 2. The opening $d_2$ forms a first restriction of the access of the lacquer into the chamber 28*a*. The bottom 26 is extended in an external tube 30 turned towards the bottom 4, itself joined to a dip tube 32 which extends as far as the bottom 4 of the container.

In the chamber 28*a* there is disposed a helical spring 34 whereof a first end 35 rests on the bottom 26 (see FIG. 2), its opposite side end 36 bearing on a circular piston 38 mounted for axial movement in the chamber 28 and forming a movable partition. The piston 38 has a peripheral annular sealing lip separating the two parts 28*a* and 28*b* of the chamber 28. This piston 38 is joined coaxially to the actuating stem 16. The stem passes through the chamber 28*b*, as well as the washer 40 and the central portion of the cup 12. A blind bore 17 passes through the emergent portion of the stem 16 as far as the level of the washer 40. At this level, a dispensing duct g continuing the bore 17 passes radially through the side of the stem 16, opening opposite the thickness of the washer 40. The stem 16 has moreover, a kneed passage p formed by a blind axial bore on the side of the chamber 28*a* which leads via a radial duct 29 from the passage p into the chamber 28*b*. The cross-section of the duct p determines the delivery rate of the valve during the dispensing of the lacquer P. The passage p has a diameter of approximately 0.2 mm to approximately 0.4 mm. This diameter is chosen in accordance with the desired delivery rate of the lacquer, as well as the viscosity of the lacquer.

In FIG. 2 it will be seen in greater detail that the first chamber 28*a* forms a premixing chamber, wherein the propellant gas G is mixed with the lacquer P when the user presses on the push button 18 in the direction of arrow F. During this action, the propellant gas present in the upper portion of the container 2 enters into the chamber 28*a* through the opening $d_1$. At the same time, the lacquer P rises under the action of the propellant gas G into the dip tube 32 and gains access to the chamber 28*a* through the second opening $d_2$.

The openings $d_1$ and $d_2$ are calibrated so as to obtain an optimum propellant gas/lacquer ratio. During the passing of the product P through the opening $d_2$, the product swirls in the chamber 28*a* and is charged with bubbles of the propellant gas. The gas/product mixtures then passes through the passage p which forms a second restriction. The gas/product mixture is accelerated at the level of the passage p.

The first opening $d_1$ has a diameter of approximately 0.2 mm to approximately 0.6 mm. The diameter of the second opening $d_2$ is approximately 0.2 mm to approximately 0.6 mm.

When this mixture arrives in the chamber 28*b*, this mixture expands, which leads to a good homogenisation of the mixture. This mixture is then passed through the dispensing duct g, the hollow stem 16 and the dispensing duct 22 towards the nozzle 20. At the outlet of the nozzle 20, there occurs a dispersal of the mixture in the form of a spraying cone of fine droplets.

Figure 3:
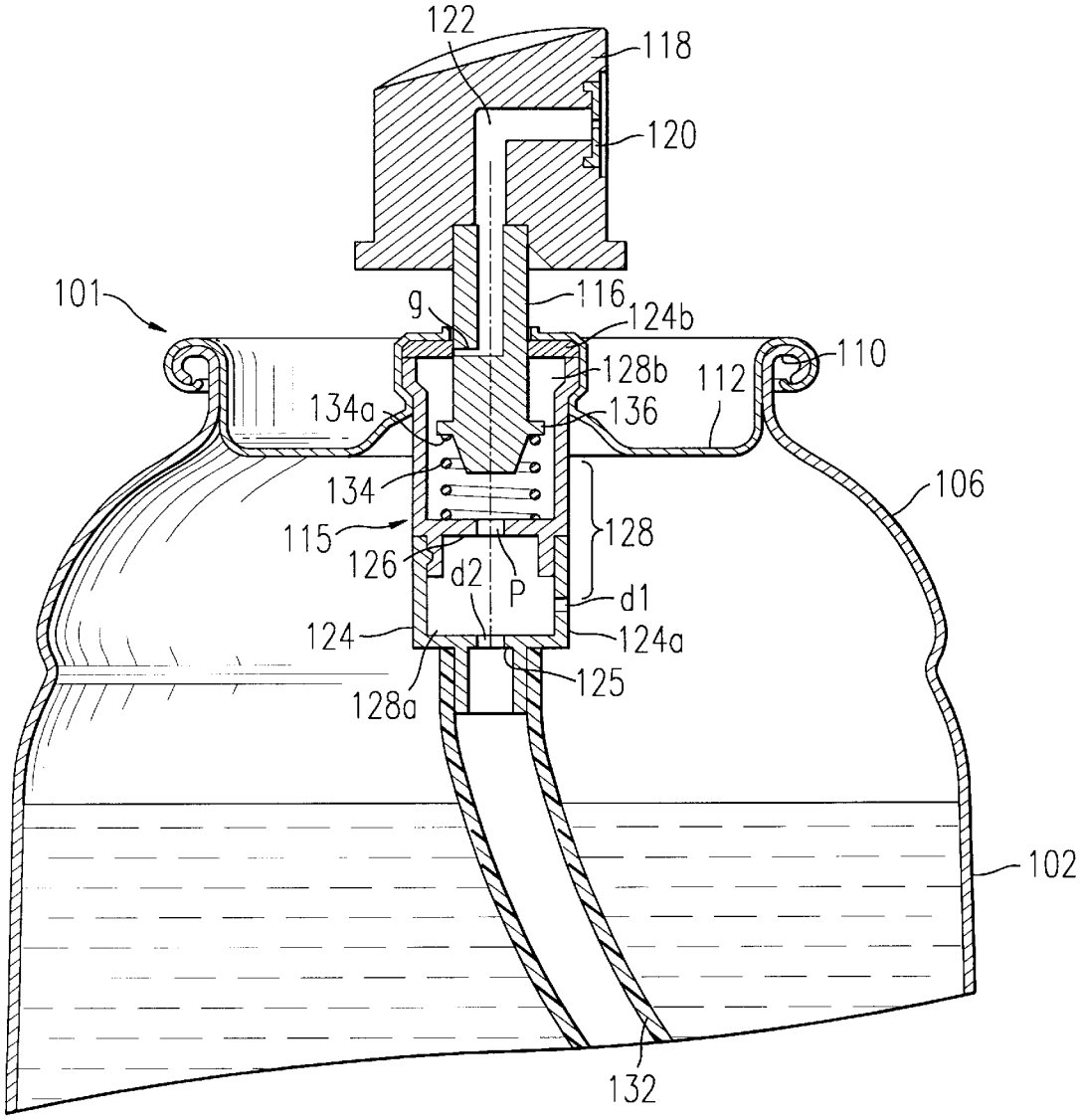
FIG. 3 shows an axial section of a dispenser according to a second embodiment of the invention in the storage position.

FIG. 3 shows in a partial axial section a variant of the dispenser 101, comprising a valve 115 that differs from that of FIG. 1. The parts that are identical with those of FIG. 1 bear the same reference numerals, increased by 100; their description will not be repeated. The valve 115 has a body 124 made of two parts, an upper part 124*b* and a lower part 124*a* that are coaxial, have the same diameter and define a chamber 128. This chamber 128 is divided into two parts 128*a*, 128*b* by a transverse partition 126 belonging to the part 124*b*. In contrast to the embodiment of FIG. 1, this partition is fixed. It has a central opening p ensuring the communication between the two chambers 128*a* and 128*b*. The actuating stem 116 does not have a piston. A portion of the stem accommodated in the upper chamber 128*b* has an annular projection 136 bearing against the free end 134*a* of the restoring spring 134. The part 124*a* has a bottom 125 pierced by an opening $d_2$ forming a second restriction of the access of the product and causing the part 124*a* to communicate with the lacquer contained in the container 102.

The functioning of this dispenser 101 is similar to the function of the dispenser of FIG. 1.

EXAMPLES OF EMBODIMENTS

A hair lacquer P was prepared having the following composition:

| | |
|---|---|
| AMERHOLD DR 25[(1)] in dispersion | 10 g |
| MEXOMER PW[(2)] in solution | 10 g |
| Methyl ether polyoxyproplyene (3) | 1 g |
| Perfume | qs |
| Water | qsp 100 g |

[(1)] AMERHOLD DR 25 sold by the AMERCHOL Company: a copolymer of ethyl acrylate/methyl methacrylate/methacrylic acid/acrylic acid in an aqueous dispersion. [(2)] MEXOMERE PW which is an anionic polymer sold by the CHIMEX Company, is composed of a terpolymer of vinyl acetate/vinyl p-tertiary butyl benzoate/crotonic acid.

The pressurization plan is as follows: in two 300 ml capacity aerosol containers, one (herein called dispenser 1) being fitted with a valve with a double chamber as described above, the second (herein called dispenser 2) being fitted with a conventional additional gas intake valve (an AQUASOL valve sold by the VALVE PRECISION Company, fitted with a 0.4 mm AQUA swirling nozzle), there are packaged:

| | |
|---|---|
| Dimethyl ether (propellant) | 70 g |
| the above mentioned lacquer P | 130 g. |

The dispenser in accordance with the invention comprises a double chamber valve having the following characteristics: $d_1$=0.3 mm; $d_2$=0.45 mm; p=0.33 mm; g=0.45 mm. The valve is connected to a semi-swirling nozzle supplied by the VALVE PRECISION Company under the commercial name of MACH III.

The result of the spraying until the propellant gas was used up was as follows:

| | dispenser 1 (invention) | dispenser 2 (prior art) |
|---|---|---|
| Formation of foam | NO | YES |
| Recovery rate of lacquer P | 94% | 87% |
| Clogging of nozzle (Spraying undertaken after a rest of 24 hours) | NO | YES |
| Average delivery | 0.26 g/s | 0.28 g/s |

These results show that the spraying performance of the dispenser 1 in accordance with the invention is distinctly higher than that of the dispenser 2 in accordance with the prior art and not conforming to the invention.

What is claimed is:

1. A dispenser for dispensing a liquid product containing at least one film-forming polymer as fine droplets, comprising:

a container containing the liquid and at least one propellant gas;

a valve for dispensing the liquid mounted on the container, the valve comprising a body provided with a first chamber and a second chamber intercommunicating via a passage; and a movable actuating element in said body and connected for actuating the valve for the dispensing of the product;

wherein the first chamber is provided with a first additional gas intake opening ($d_1$), and a second opening ($d_2$) for the intake of the liquid in permanent communication with this liquid; wherein the second chamber at least partially comprises the actuating element; wherein the liquid contains water at at least 15% of the total weight of the product; wherein the first opening ($d_1$) and the second opening ($d_2$) have diameters such that the ratio of the diameters of said first and second openings is approximately 0.3 to 1; and wherein said passage and said actuating element are constructed such that the delivery rate of the valve during the dispensing of the product is determined by the cross-section of the passage.

2. A dispenser according to claim 1, further comprising a dispensing head provided with a spraying nozzle communicating with the valve.

3. A dispenser according to claim 2, wherein the nozzle is a swirling or a semi-swirling nozzle.

4. A dispenser according to claim 1, wherein the valve is a push-down type valve.

5. A dispenser according to claim 1, wherein the element for actuating the valve comprises a hollow actuating stem emerging from the valve body and capable of being urged against an elastic restoring element accommodated in the valve body.

6. A dispenser according to claim 5, wherein the stem has a dispensing duct that is obturated in the rest position of the valve and open during the dispensing of the product, this duct having a diameter greater than the diameter of the passage.

7. A dispenser according to claim 6, wherein the dispensing duct has a diameter of approximately 0.4 mm to approximately 1.0 mm.

8. A dispenser according to claim 1, wherein the passage has a diameter chosen in such a way that the delivery rate of the product is approximately 200 mg/s to approximately 600 mg/s during the dispensing.

9. A dispenser according to claim 1, wherein the passage has a diameter of approximately 0.2 mm to approximately 0.5 mm.

10. A dispenser according to claim 1, wherein the first opening ($d_1$) has a diameter at most equal to the diameter of the second opening ($d_2$).

11. A dispenser according to claim 1, wherein the first opening ($d_1$) has a diameter of approximately 0.2 mm to approximately 0.6 mm.

12. A dispenser according to claim 1, wherein the second opening ($d_2$) has a diameter of approximately 0.2 mm to approximately 0.6 mm.

13. A dispenser according to claim 1, wherein the first chamber and the second chamber are aligned on the same axis.

14. A dispenser according to claim 1, wherein the product is a hair product.

15. A dispenser according to claim 1, wherein the polymer is dispersed in the product.

16. A dispenser according to claim 1, wherein the polymer is the result of the polymerization or copolymerization of monomers chosen from styrene, butadiene, ethylene, propylene, toluene vinyl, propionate vinyl, vinyl alcohol, acrylonitrile, chloroprene, vinyl acetate, urethanes, isoprene, isobutene, and the esters or amides of acrylic or methacrylic acids, maleic, crotonic or itaconic acids, vinyl ether, vinyl pyrrolidone, and vinyl imidazole.

17. A dispenser according to claim 1, wherein the polymer is chosen from polyesters, polyamides, polyurethanes and polyethers.

18. A dispenser according to claim 1, wherein the polymer is present in a proportion equal to at least 15% of the total weight of the product (excluding the propellant).

19. A dispenser according to claim 1, wherein the proportion of the polymer is chosen from 15% to 50% of the total weight of the product (excluding the propellant).

20. A dispenser according to claim 1, wherein the proportion of the polymer is chosen from 15% to 35% of the total weight of the product (excluding the propellant).

21. A dispenser according to claim 1, wherein the product contains ethyl alcohol.

22. A dispenser according to claim 1, wherein the propellant gas is chosen from volatile hydrocarbons, dimethylether, carbon dioxide, nitrogen monoxide, nitrogen, compressed air and their mixtures.

23. A dispenser according to claim 1, wherein said passage is formed by a stationary element.

24. A dispenser according to claim 1, wherein said passage is continually open.

25. A method of dispensing a hair lacquer in the form of fine droplets comprising dispensing the hair lacquer from the dispenser of claim 1.

* * * * *